US010677270B2

(12) United States Patent
Suzuki et al.

(10) Patent No.: US 10,677,270 B2
(45) Date of Patent: Jun. 9, 2020

(54) FLUID PRESSURE CYLINDER

(71) Applicant: SMC CORPORATION, Chiyoda-ku (JP)

(72) Inventors: Yasunaga Suzuki, Kasukabe (JP); Chiaki Fukui, Abiko (JP); Makoto Yaegashi, Tsukubamirai (JP)

(73) Assignee: SMC CORPORATION, Tokyo (JP)

( * ) Notice: Subject to any disclaimer, the term of this patent is extended or adjusted under 35 U.S.C. 154(b) by 0 days.

(21) Appl. No.: 15/580,124

(22) PCT Filed: Jun. 1, 2016

(86) PCT No.: PCT/JP2016/002638
§ 371 (c)(1),
(2) Date: Dec. 6, 2017

(87) PCT Pub. No.: WO2016/199376
PCT Pub. Date: Dec. 15, 2016

(65) Prior Publication Data

US 2018/0298927 A1 Oct. 18, 2018

(30) Foreign Application Priority Data

Jun. 11, 2015 (JP) ..... 2015-118205

(51) Int. Cl.
*F15B 15/14* (2006.01)
*F15B 15/28* (2006.01)
*F15B 15/22* (2006.01)

(52) U.S. Cl.
CPC ..... *F15B 15/1447* (2013.01); *F15B 15/1428* (2013.01); *F15B 15/1438* (2013.01);
(Continued)

(58) Field of Classification Search
CPC .. F15B 15/1447; F15B 15/223; F15B 15/227; F15B 15/2861
See application file for complete search history.

(56) References Cited

U.S. PATENT DOCUMENTS 2,616,687 A 11/1952 Butterfield
3,136,225 A 6/1964 Rader
(Continued)

FOREIGN PATENT DOCUMENTS

CH 643 638 A5 6/1984
CN 1272167 A 11/2000
(Continued)

OTHER PUBLICATIONS

Japanese Office Action dated Aug. 7, 2018 in Japanese Patent Application No. 2015-118190 (with English translation), 6 pages.
(Continued)

*Primary Examiner* — Michael Leslie
(74) *Attorney, Agent, or Firm* — Oblon, McClelland, Maier & Neustadt, L.L.P.

(57) ABSTRACT

In an interior of a cylinder tube of a fluid pressure cylinder, a piston unit is provided, which is displaced along an axial direction under the supply of a pressure fluid. The piston unit includes a disk shaped plate body, which is connected to one end of a piston rod, and a ring body connected to an outer edge portion of the plate body. The plate body is connected to the piston rod by plural second rivets, which are punched in an axial direction with respect to the piston rod.

7 Claims, 11 Drawing Sheets

(52) U.S. Cl.
CPC ..... *F15B 15/227* (2013.01); *F15B 15/2861* (2013.01); *F15B 15/223* (2013.01)

(56) References Cited

U.S. PATENT DOCUMENTS

| | | | | |
|---|---|---|---|---|
| 3,175,474 | A | 3/1965 | Eickmann | |
| 3,655,204 | A | 4/1972 | Sievenpiper | |
| 3,835,753 | A | 9/1974 | Bunyard | |
| 4,086,456 | A | 4/1978 | Bone | |
| 4,312,264 | A | 1/1982 | Nunnemacher et al. | |
| 4,370,918 | A | 2/1983 | Pringle | |
| 4,896,584 | A | 1/1990 | Stoll et al. | |
| 5,193,433 | A | 3/1993 | Reimer | |
| 5,241,896 | A | 9/1993 | Braun et al. | |
| 5,400,696 | A | 3/1995 | Weber | |
| 5,618,142 | A | 4/1997 | Sonden et al. | |
| 5,651,631 | A | 7/1997 | Carmien | |
| 6,038,959 | A | 3/2000 | Sawada | |
| 6,186,484 | B1 | 2/2001 | Noda et al. | |
| 6,199,847 | B1 | 3/2001 | Fukui | |
| 6,386,088 | B1 | 5/2002 | Yoshimoto et al. | |
| 7,557,568 | B2 * | 7/2009 | Terasaki | F15B 15/2861 324/207.2 |
| 7,798,052 | B2 * | 9/2010 | Ikari | F15B 15/1447 91/409 |
| 9,038,527 | B2 * | 5/2015 | Orihara | F15B 15/20 91/404 |
| 9,353,861 | B2 * | 5/2016 | Ishibashi | F15B 15/1447 |
| 9,410,624 | B2 | 8/2016 | George | |
| 2004/0107557 | A1 | 6/2004 | Morris et al. | |
| 2007/0048156 | A1 | 3/2007 | Chung et al. | |
| 2008/0173169 | A1 | 7/2008 | Ikari | |
| 2013/0032027 | A1 * | 2/2013 | Orihara | F15B 15/20 91/418 |
| 2014/0069271 | A1 | 3/2014 | Ishibashi et al. | |
| 2014/0076157 | A1 | 3/2014 | Fukui | |
| 2015/0267723 | A1 | 9/2015 | Kim | |
| 2016/0084220 | A1 | 3/2016 | Moeller et al. | |
| 2017/0191507 | A1 | 7/2017 | Marinoni et al. | |
| 2017/0298931 | A1 * | 10/2017 | Kudo | F15B 15/2861 |
| 2018/0135662 | A1 * | 5/2018 | Suzuki | F15B 15/1414 |
| 2018/0135663 | A1 * | 5/2018 | Suzuki | F15B 15/1447 |
| 2018/0135664 | A1 * | 5/2018 | Suzuki | F15B 15/1461 |
| 2018/0172036 | A1 * | 6/2018 | Suzuki | F15B 15/1447 |
| 2018/0298926 | A1 * | 10/2018 | Suzuki | F15B 15/1438 |

FOREIGN PATENT DOCUMENTS

| | | | |
|---|---|---|---|
| CN | 201170227 | Y | 12/2008 |
| CN | 201599273 | U | 10/2010 |
| CN | 103562567 | A | 2/2014 |
| DE | 81 24 287 | U1 | 12/1981 |
| DE | 199 25 600 | A1 | 12/2000 |
| DE | 101 41 560 | A1 | 3/2003 |
| DE | 10 2009 020 286 | A1 | 11/2010 |
| EP | 0 190 528 | A1 | 8/1986 |
| EP | 1 001 174 | A1 | 5/2000 |
| EP | 2 716 920 | A1 | 4/2014 |
| FR | 2 575 527 | A1 | 7/1986 |
| JP | 48-14117 | Y1 | 4/1973 |
| JP | 50-152085 | | 12/1975 |
| JP | 52-125985 | A | 10/1977 |
| JP | 56-5605 | Y1 | 2/1981 |
| JP | 56-115010 | U | 9/1981 |
| JP | 59-1493 | U | 1/1984 |
| JP | 62-107103 | U | 7/1987 |
| JP | 63-111303 | A | 5/1988 |
| JP | 5-6204 | U | 1/1993 |
| JP | 5-59212 | U | 8/1993 |
| JP | 52-27972 | | 3/1997 |
| JP | 11-37112 | A | 2/1999 |
| JP | 11-62910 | A | 3/1999 |
| JP | 11-132204 | A | 5/1999 |
| JP | 11-153104 | A | 6/1999 |
| JP | 2000-074007 | A | 3/2000 |
| JP | 2005-54977 | A | 3/2005 |
| JP | 2007-16916 | A | 1/2007 |
| JP | 2008-133920 | A | 6/2008 |
| JP | 2012-57770 | A | 3/2012 |
| JP | 2014-219038 | A | 11/2014 |
| KR | 10-2014-0034198 | A | 3/2014 |
| KR | 10-2014-0074845 | A | 6/2014 |
| TW | M495452 | U | 2/2015 |
| WO | WO 2012/161159 | A1 | 11/2012 |
| WO | WO 2013/026508 | A1 | 2/2013 |

OTHER PUBLICATIONS

Japanese Office Action dated Aug. 7, 2018 in Japanese Patent Application No. 2015-118174 (with English translation), 9 pages.
International Search Report and Written Opinion dated Oct. 13, 2016 in PCT/JP2016/002638 filed Jun. 1, 2016.
Office Action dated Jan. 9, 2018 in Japanese Patent Application No. 2015-118174 (with English language translation).
Office Action dated Jan. 9, 2018 in Japanese Patent Application No. 2015-118182 (with English language translation).
Office Action dated Jan. 9, 2018 in Japanese Patent Application No. 2015-118190 (with English language translation).
Combined Chinese Office Action and Search Report dated Jan. 11, 2019 in Chinese Patent Application No. 201680033247.0 (with English translation), 12 pages.
Combined Chinese Office Action and Search Report dated Dec. 26, 2018 in Chinese Patent Application No. 201680033635.9 (with English translation), 12 pages.
Combined Chinese Office Action and Search Report dated Dec. 27, 2018 in Chinese Patent Application No. 201680033652.2 (with English translation), 16 pages.
Combined Chinese Office Action and Search Report dated Jan. 16, 2019 in Chinese Patent Application No. 201680033671.5 (with English translation), 17 pages.
Office Action dated Mar. 18, 2019 in Korean Patent Application No. 10-2018-7000911, 8 pages (with unedited computer generated English translation).
Office Action dated Mar. 18, 2019 in Korean Patent Application No. 10-2018-7000913, 7 pages (with unedited computer generated English translation).
Office Action dated Mar. 18, 2019 in Korean Patent Application No. 10-2018-7000915, 7 pages (with unedited computer generated English translation).
Office Action dated May 14, 2019 in co-pending U.S. Appl. No. 15/580,109, 10 pages.
Office Action dated Jun. 3, 2019 in co-pending U.S. Appl. No. 15/580,106, 11 pages.
Office Action dated May 21, 2019 in co-pending U.S. Appl. No. 15/580,133, 15 pages.
Office Action dated Jun. 24, 2019, in co-pending U.S. Appl. No. 15/580,125, 12 pages.
Office Action dated Jun. 24, 2019, in co-pending U.S. Appl. No. 15/580,125, 13 pages.
Korean Office Action dated Aug. 5, 2019 in Korean Patent Application No. 10-2018-7000911 (with unedited computer generated English translation), 9 pages.
Combined Chinese Office Action and Search Report dated Aug. 14, 2019 in Chinese Patent Application No. 201680033045.6 (with English translation), 17 pages.
Office Action dated Aug. 8, 2019 in co-pending U.S. Appl. No. 15/580,098, 14 pages.
U.S. Office Action dated Nov. 4, 2019 in U.S. Appl. No. 15/580,125.
Indian Office Action dated Jan. 1, 2020 in Patent Application No. 201847000221 (with English translation), 5 pages.

* cited by examiner

FLUID PRESSURE CYLINDER

TECHNICAL FIELD

The present invention relates to a fluid pressure cylinder that displaces a piston in an axial direction under the supply of a pressure fluid.

BACKGROUND ART

Conventionally, as a transport means for a workpiece or the like, for example, a fluid pressure cylinder having a piston that is displaced under the supply of a pressure fluid has been used. The present applicant has proposed a fluid pressure cylinder, as disclosed in Japanese Laid-Open Patent Publication No. 2008-133920, which is closed on both ends by a head cover and a rod cover, and in which the head cover and the rod cover are tightly fastened together with the cylinder tube by four connecting rods.

With this type of fluid pressure cylinder, a piston and a piston rod are disposed for displacement in the interior of the cylinder tube, and by supplying a pressure fluid into cylinder chambers that are formed between the piston and the cylinder tube, the piston is displaced along the axial directions.

SUMMARY OF INVENTION

Recently, on a manufacturing line in which the aforementioned fluid pressure cylinder is used, it has been desired to promote compactness of the line, and along therewith, to make the fluid pressure cylinder smaller in scale.

A general object of the present invention is to provide a fluid pressure cylinder, in which a dimension of the fluid pressure cylinder along an axial direction thereof can be made smaller in size.

The present invention is characterized by a fluid pressure cylinder comprising a cylinder tube including cylinder chambers defined in interior thereof, a cover member attached to an end of the cylinder tube, a piston disposed displaceably along the cylinder chambers, and a piston rod that is connected to the piston, wherein a central portion of the piston is connected with respect to the piston rod by insertion of a pin member therein and plastically deforming the pin member.

According to the present invention, in the fluid pressure cylinder, a central portion of the piston, which is disposed displaceably along the cylinder chambers of the cylinder tube, is connected by insertion of the pin member into the piston rod and plastically deforming the pin member.

Consequently, for example, compared to a conventional fluid pressure cylinder in which the piston is connected by a screw or the like with respect to the piston rod, roughly the same fastening force can be obtained through use of a pin member, which has a shorter axial length than a screw, and thus, the dimension of the piston in the axial direction can be made shorter. As a result, the dimension of the fluid pressure cylinder including the piston along the axial direction can be made smaller in size.

The above and other objects, features and advantages of the present invention will become more apparent from the following description when taken in conjunction with the accompanying drawings, in which preferred embodiments of the present invention are shown by way of illustrative example.

DESCRIPTION OF EMBODIMENTS

Figure 1:
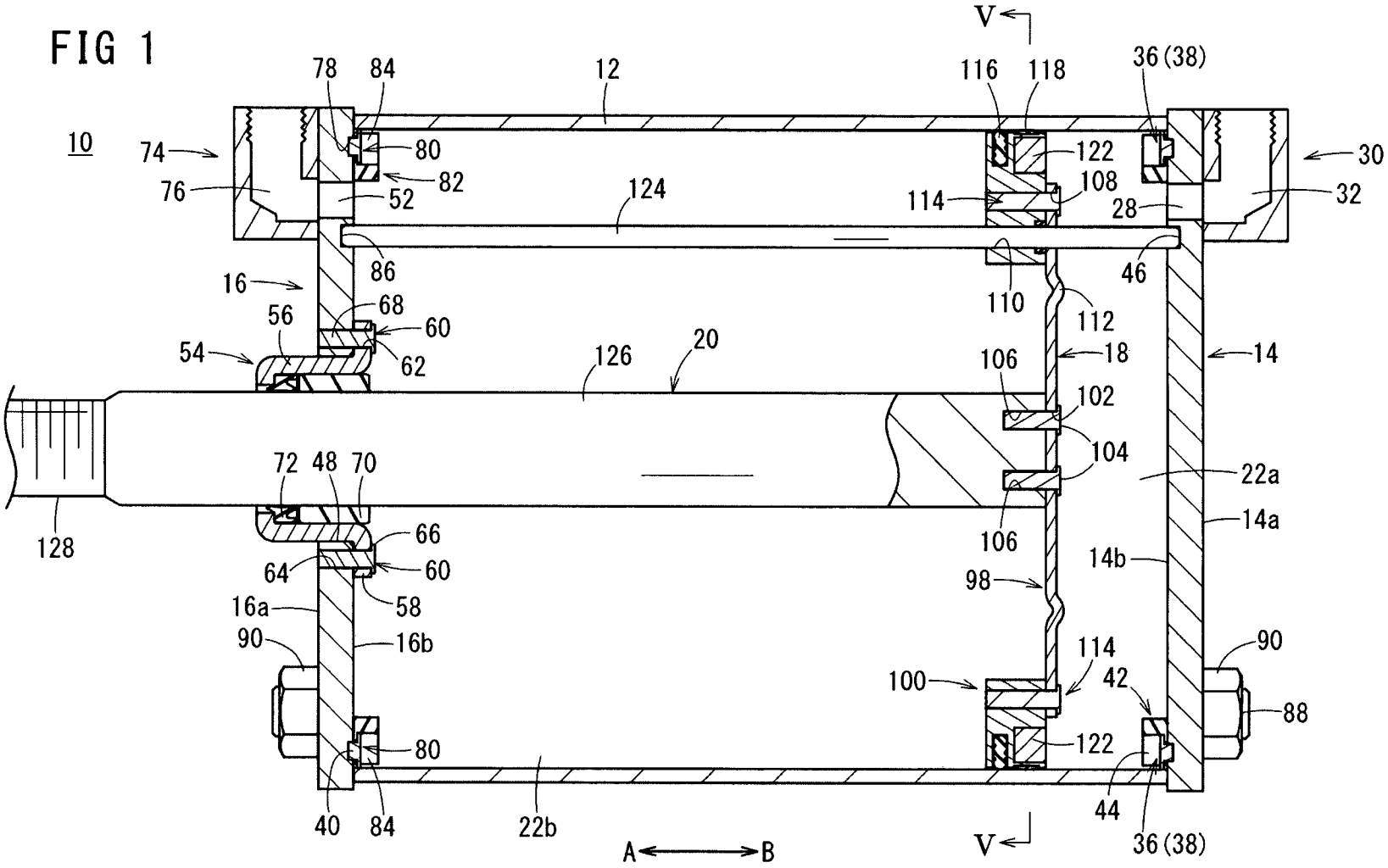
FIG. 1 is an overall cross-sectional view of a fluid pressure cylinder according to a first embodiment of the present invention.

As shown in FIG. 1, a fluid pressure cylinder 10 includes a tubular or cylindrically shaped cylinder tube 12, a head cover (cover member) 14 that is mounted on one end of the cylinder tube 12, a rod cover (cover member) 16 that is mounted on another end of the cylinder tube 12, a piston unit (piston) 18 that is disposed for displacement in the interior of the cylinder tube 12, and a piston rod 20 that is connected to the piston unit 18.

The cylinder tube 12, for example, is constituted from a cylindrical body that is formed from a metal material, and extends with a constant cross-sectional area along the axial direction (the directions of arrows A and B), and in the interior thereof, cylinder chambers 22*a*, 22*b* are formed in which the piston unit 18 is accommodated. Further, on both ends of the cylinder tube 12, ring shaped seal members (not shown) are installed respectively through annular grooves.

As shown in FIGS. 1 through 3A and 4A, the head cover 14, for example, is a plate body that is formed with a substantially rectangular shape in cross section from a metal material, which is provided to cover one end of the cylinder tube 12. At this time, by the seal member (not shown), which is disposed on the end of the cylinder tube 12, abutting against the head cover 14, a pressure fluid is prevented from leaking out from the cylinder chamber 22*a* through a gap between the cylinder tube 12 and the head cover 14.

Figure 4A:
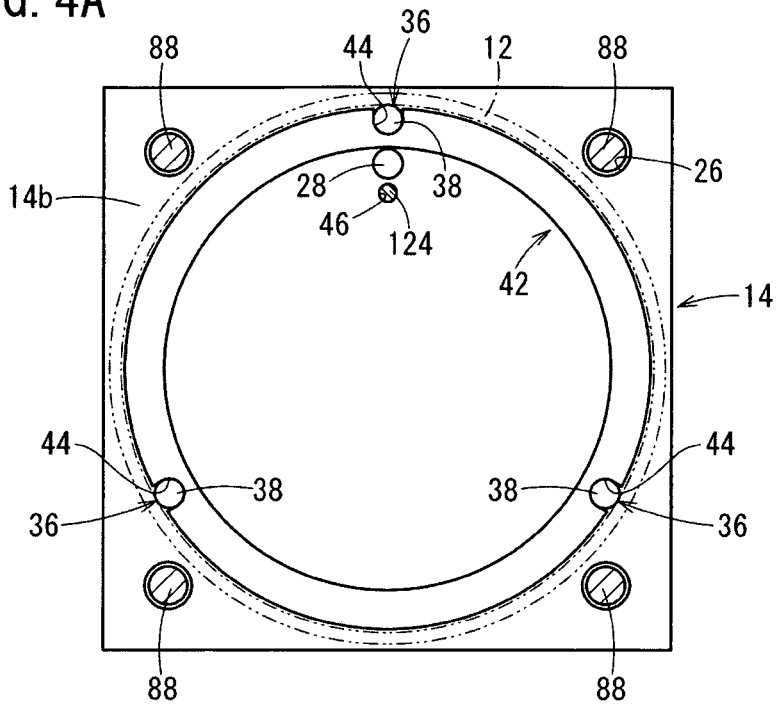
FIG. 4A is a front view shown partially in cross section of the head cover of FIG. 3A as seen from a side of the cylinder tube.

Further, as shown in FIG. 4A, in the vicinity of the four corners of the head cover 14, four first holes 26 are formed, respectively, through which later-described connecting rods 88 are inserted. A first communication hole 28 is formed at a position on a central side of the head cover 14 with respect to the first holes 26. The first holes 26 and the first communication hole 28 penetrate respectively in a thickness direction (the directions of arrows A and B) of the head cover 14 shown in FIGS. 1 and 2.

A first port member 30 from which the pressure fluid is supplied and discharged is provided on an outer wall surface 14*a* of the head cover 14, to which a pressure fluid supply source is connected through a non-illustrated pipe. The first port member 30, for example, is constituted from a block body, which is formed from a metal material, and is fixed by welding or the like.

Further, in the interior of the first port member 30, a port passage 32, which is formed with an L-shape in cross-section, is formed, and an opening thereof is fixed with respect to the outer wall surface 14*a* of the head cover 14 in a state of being opened in a direction perpendicular to the axial direction of the cylinder tube 12.

In addition, by the port passage 32 of the first port member 30 communicating with the first communication hole 28 of the head cover 14, the first port member 30 and the interior of the cylinder tube 12 are placed in communication.

Instead of providing the first port member 30, for example, a pipe connection fitting may be connected directly with respect to the first communication hole 28.

Figure 2:
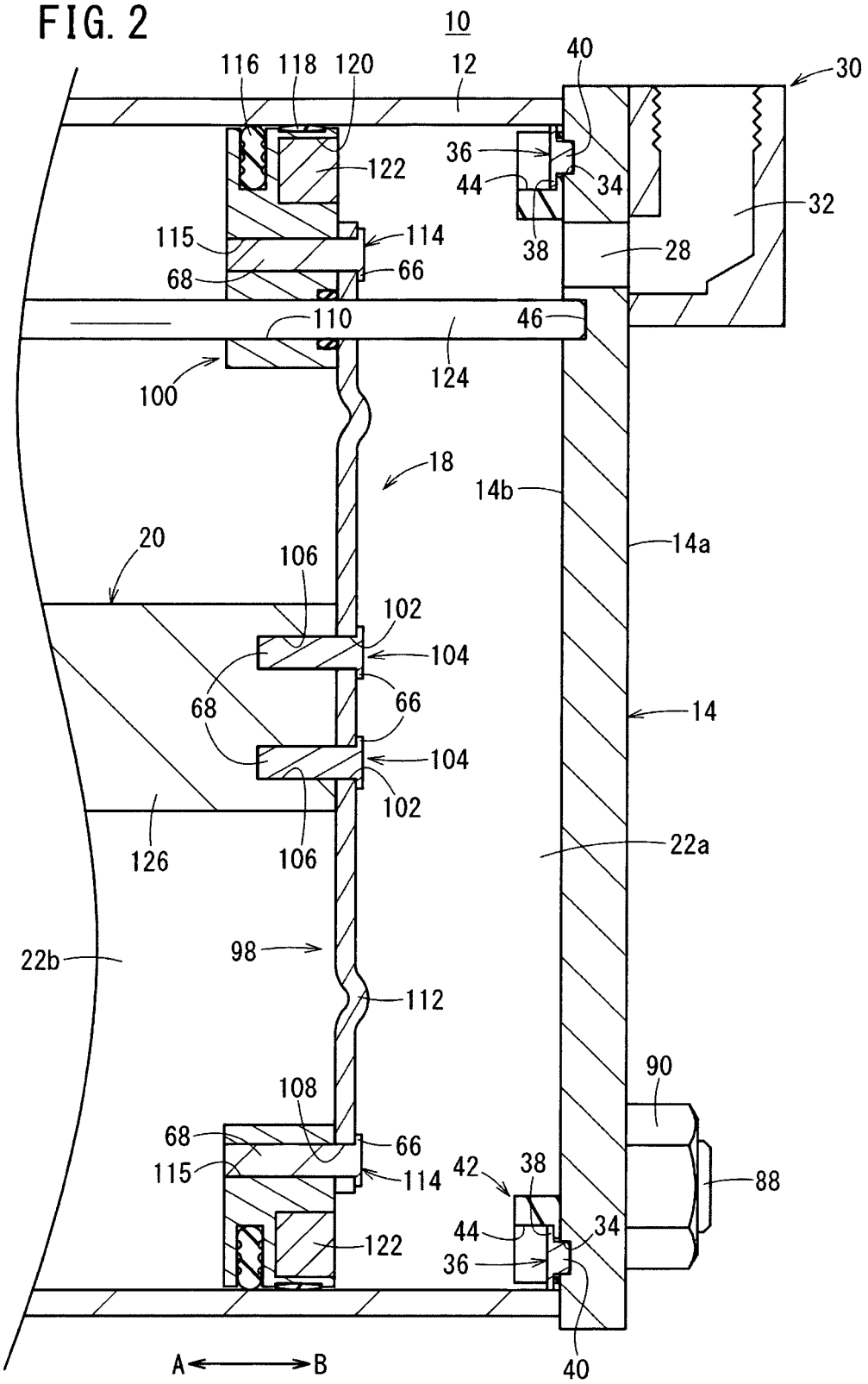
FIG. 2 is an enlarged cross-sectional view of the vicinity of a piston unit in the fluid pressure cylinder of FIG. 1.

On the other hand, on an inner wall surface 14*b* of the head cover 14 formed on a side of the cylinder tube 12 (in the direction of the arrow A), as shown in FIGS. 1, 2, and 4A, a plurality of (for example, three) first pin holes 34 are formed on a circumference that is smaller in diameter than the inner circumferential diameter of the cylinder tube 12, and first spigot pins 36 are inserted respectively into the first pin holes 34. The first pin holes 34 are formed on a circumference having a predetermined diameter with respect to the center of the head cover 14, and are separated by equal intervals mutually along the circumferential direction.

The first spigot pins 36 are disposed in a plurality so as to be of the same number as the first pin holes 34, and are made up from flange members 38 formed with circular shapes in cross section, and shaft members 40 of a smaller diameter than the flange members 38 which are inserted into the first pin holes 34. In addition, by press-fitting of the shaft members 40 of the first spigot pins 36 into the first pin holes 34, the first spigot pins 36 are fixed, respectively, to the inner wall surface 14*b* of the head cover 14, and the flange members 38 thereof are in a state of projecting out with respect to the inner wall surface 14*b* of the head cover 14.

When the cylinder tube 12 is assembled with respect to the head cover 14, as shown in FIG. 4A, the outer circumferential surfaces of the flange members 38 of the first spigot pins 36 come into internal contact with, i.e., inscribe, respectively, the inner circumferential surface of the cylinder tube 12, whereby the cylinder tube 12 is positioned with respect to the head cover 14. More specifically, the plural first spigot pins 36 function as positioning means for positioning the one end of the cylinder tube 12 with respect to the head cover 14.

Stated otherwise, the first spigot pins 36 are arranged on a circumference having a predetermined diameter so that the outer circumferential surfaces thereof internally contact or inscribe the inner circumferential surface of the cylinder tube 12.

A ring shaped first damper 42 is disposed on the inner wall surface 14*b* of the head cover 14. The first damper 42, for example, is formed with a predetermined thickness from a resilient material such as rubber or the like, and the inner circumferential surface thereof is arranged more on a radial outward side than the first communication hole 28 (see FIGS. 2 and 4A).

Further, in the first damper 42, plural cutaway sections 44 are included, which are recessed with substantially circular shapes in cross section radially inward from the outer circumferential surface of the first damper 42, and the first spigot pins 36 are inserted through the cutaway sections 44. More specifically, the cutaway sections 44 are provided in the same number, at the same pitch, and on the same circumference as the first spigot pins 36. In addition, as shown in FIG. 2, by the first damper 42 being sandwiched between the inner wall surface 14*b* of the head cover 14 and the flange members 38 of the first spigot pins 36, the first damper 42 is retained in a state of projecting out at a predetermined height with respect to the inner wall surface 14*b*.

More specifically, at the same time as functioning as positioning means (spigot means) for positioning the one end of the cylinder tube 12 at a predetermined position with respect to the head cover 14, the first spigot pins 36 also function as fixing means for fixing the first damper 42 to the head cover 14.

In addition, when the piston unit 18 is displaced to the side of the head cover 14 (in the direction of the arrow B), by the end thereof coming into abutment against the first damper 42, direct contact between the piston unit 18 and the head cover 14 is avoided, and the occurrence of shocks and impact noises accompanying such contact is suitably prevented.

Further, a first rod hole 46 in which a later-described guide rod 124 is supported is formed in the head cover 14 at a position located further toward the central side with respect to the first communication hole 28. The first rod hole 46 opens toward the side of the inner wall surface 14*b* of the head cover 14 (in the direction of the arrow A) and does not penetrate through to the outer wall surface 14*a*.

Figure 3A:
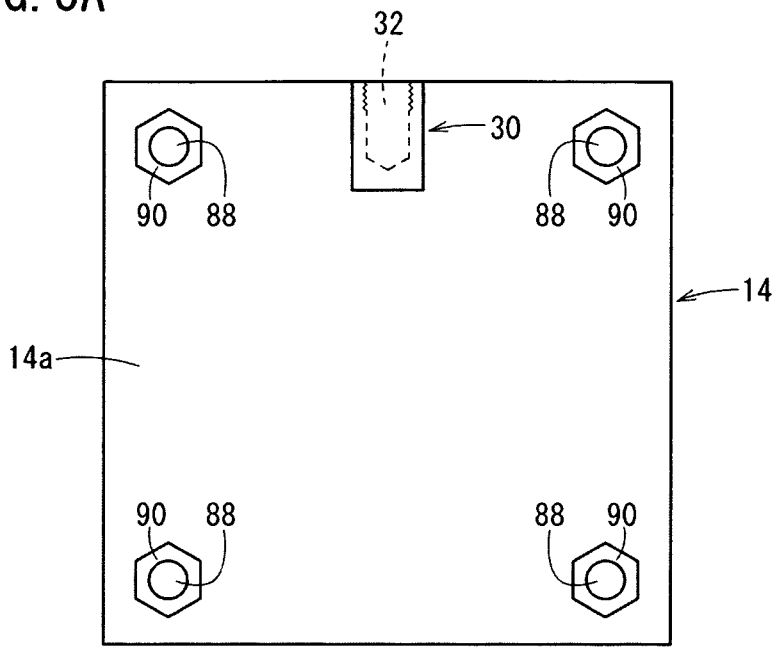
FIG. 3A is a front view as seen from a side of a head cover in the fluid pressure cylinder of FIG. 1.
Figure 3B:
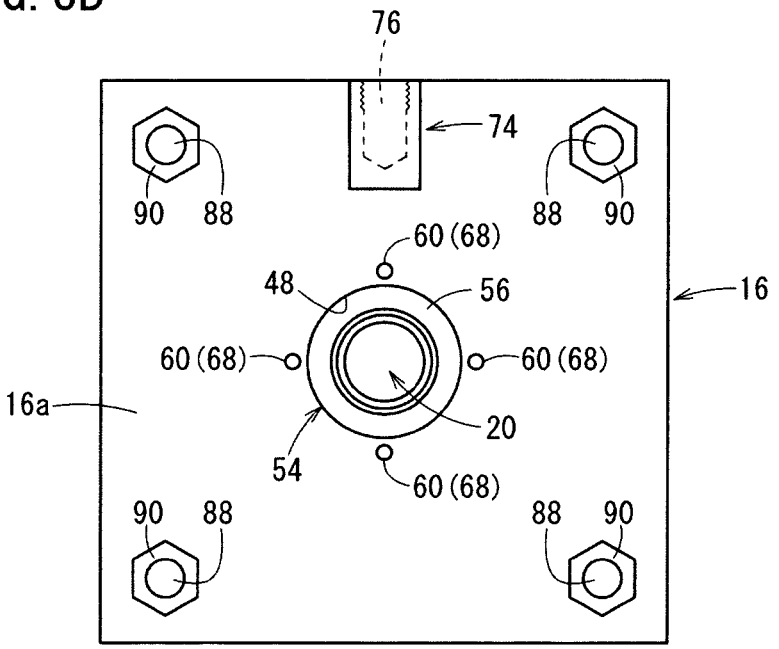
FIG. 3B is a front view as seen from a side of a rod cover in the fluid pressure cylinder of FIG. 1.
Figure 4B:
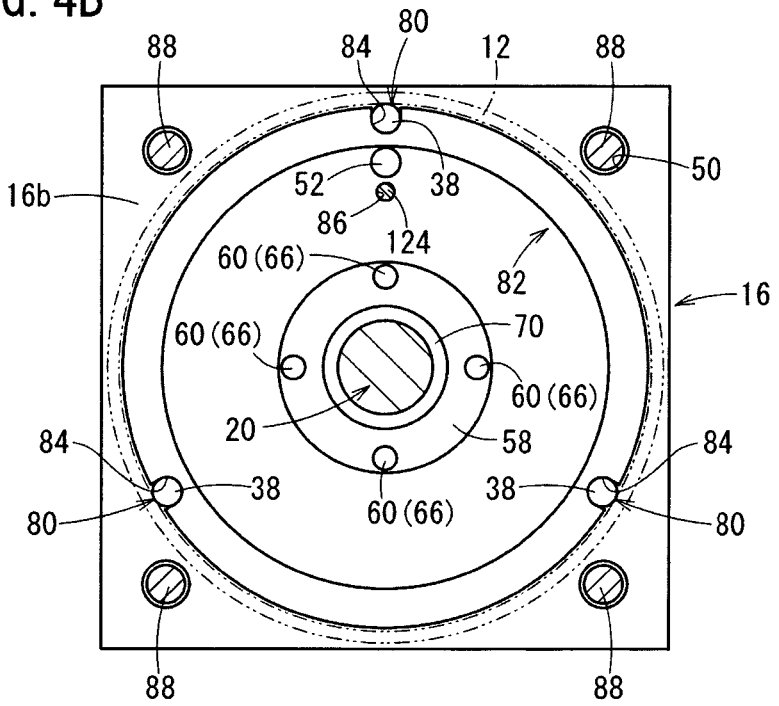
FIG. 4B is a front view shown partially in cross section of the rod cover of FIG. 3B as seen from a side of the cylinder tube.

As shown in FIGS. 1, 3B, and 4B, the rod cover 16, in the same manner as the head cover 14, for example, is a plate body that is formed with a substantially rectangular shape in cross section from a metal material, which is provided to cover the other end of the cylinder tube 12. At this time, by the seal member (not shown), which is disposed on the end of the cylinder tube 12, abutting against the rod cover 16, the pressure fluid is prevented from leaking out from the cylinder chamber 22*b* through a gap between the cylinder tube 12 and the rod cover 16.

A rod hole 48 is formed to penetrate in an axial direction (the directions of arrows A and B) through the center of the rod cover 16, and four second holes 50 through which the later-described connecting rods 88 are inserted are formed in the four corners of the rod cover 16. Further, a second communication hole 52 is formed in the rod cover 16 at a position located on the central side with respect to the second holes 50. The rod hole 48, the second holes 50, and the second communication hole 52 are formed to penetrate respectively in the thickness direction (the directions of arrows A and B) through the rod cover 16.

A holder 54 that displaceably supports the piston rod 20 is provided in the rod hole 48. The holder 54, for example, is formed by a drawing process or the like from a metal material, and includes a cylindrical holder main body 56, and a flange member 58 formed on one end of the holder main body 56 and which is expanded radially outward in diameter. A portion of the holder main body 56 is disposed so as to project outside from the rod cover 16 (see FIG. 1).

In addition, in a state in which the holder main body 56 is inserted through the rod hole 48 of the rod cover 16, and the flange member 58 is arranged on the side of the cylinder tube 12 (in the direction of the arrow B), the flange member 58 abuts against an inner wall surface 16*b* of the rod cover 16, and a plurality of (for example, four) first rivets 60 are inserted into and made to engage with first rivet holes 64 of the rod cover 16 via first through holes 62 of the flange member 58. As a result, the holder 54 is fixed with respect to the rod hole 48 of the rod cover 16. At this time, the holder 54 is fixed coaxially with the rod hole 48.

The first rivets 60, for example, are self-drilling or self-piercing rivets each having a circular flange member 66, and a shaft-shaped pin member 68 that is reduced in diameter with respect to the flange member 66. In a state with the first rivets 60 being inserted into the first through holes 62 from the side of the flange member 58, and the flange members 66 thereof engaging with the flange member 58, by punching the pin members 68 into the first rivet holes 64 of the rod cover 16, the pin members 68 are engaged with respect to the first through holes 62, and the flange member 58 is fixed with respect to the rod cover 16.

The first rivets 60 are not limited to being self-drilling rivets, and for example, may be general rivets that are fixed by having the pin members 68 thereof crushed and deformed after having been pushed out to the side of an outer wall surface 16*a* of the rod cover 16.

A bush 70 and a rod packing 72 are disposed alongside one another in the axial direction (the directions of arrows A and B) in the interior of the holder 54, and by the later-described piston rod 20 being inserted through the interior portion thereof, simultaneously with the piston rod 20 being guided along the axial direction by the bush 70, the rod packing 72 slides in contact therewith, whereby leakage of pressure fluid through a gap between the holder 54 and the rod packing 72 is prevented.

As shown in FIGS. 1 and 3B, a second port member 74 from which the pressure fluid is supplied and discharged is provided on the outer wall surface 16*a* of the rod cover 16, to which a pressure fluid supply source is connected through a non-illustrated pipe. The second port member 74, for example, is constituted from a block body, which is formed from a metal material, and is fixed by welding or the like.

Further, in the interior of the second port member 74, a port passage 76, which is formed with an L-shape in cross-section, is formed, and an opening thereof is fixed with respect to the outer wall surface 16*a* of the rod cover 16 in a state of being opened in a direction perpendicular to the axial direction of the cylinder tube 12.

In addition, by the port passage 76 of the second port member 74 communicating with the second communication hole 52 of the rod cover 16, the second port member 74 and the interior of the cylinder tube 12 are placed in communication.

Instead of providing the second port member 74, for example, a pipe connection fitting may be connected directly with respect to the second communication hole 52.

On the other hand, on the inner wall surface 16*b* of the rod cover 16 that is formed on a side of the cylinder tube 12 (in the direction of the arrow B), as shown in FIGS. 1 and 4B, a plurality of (for example, three) second pin holes 78 are formed on a circumference that is smaller in diameter than the inner circumferential diameter of the cylinder tube 12, and second spigot pins 80 are inserted respectively into the second pin holes 78. More specifically, the second spigot pins 80 are provided in plurality in the same number as the second pin holes 78.

The second pin holes 78 are formed on a circumference having a predetermined diameter with respect to the center of the rod cover 16, and are separated by equal intervals mutually along the circumferential direction. The second spigot pins 80 are formed in the same shape as the first spigot pins 36, and therefore, detailed description thereof is omitted.

In addition, by insertion of the shaft members 40 of the second spigot pins 80 into the second pin holes 78, the second spigot pins 80 are fixed, respectively, to the inner wall surface 16*b* of the rod cover 16, and the flange members 38 thereof are in a state of projecting out with respect to the inner wall surface 16*b* of the rod cover 16.

Further, when the cylinder tube 12 is assembled with respect to the rod cover 16, as shown in FIG. 4B, the outer circumferential surfaces of the flange members 38 of the second spigot pins 80 come into internal contact with, i.e., inscribe, respectively, the inner circumferential surface of the cylinder tube 12, whereby the cylinder tube 12 is positioned with respect to the rod cover 16. More specifically, the plural second spigot pins 80 function as positioning means for positioning the other end of the cylinder tube 12 with respect to the rod cover 16.

Stated otherwise, the second spigot pins 80 are arranged on a circumference having a predetermined diameter so that the outer circumferential surfaces thereof internally contact or inscribe the inner circumferential surface of the cylinder tube 12.

A ring shaped second damper 82 is disposed on the inner wall surface 16*b* of the rod cover 16. The second damper 82, for example, is formed with a predetermined thickness from a resilient material such as rubber or the like, and the inner circumferential surface thereof is arranged more radially outward than the second communication hole 52.

Further, in the second damper 82, plural cutaway sections 84 are included, which are recessed with substantially circular shapes in cross section radially inward from the outer circumferential surface of the second damper 82, and the second spigot pins 80 are inserted through the cutaway sections 84. In addition, by the second damper 82 being sandwiched between the inner wall surface 16*b* of the rod cover 16 and the flange members 38 of the second spigot pins 80, the second damper 82 is retained in a state of projecting out at a predetermined height with respect to the inner wall surface 16*b*.

More specifically, the cutaway sections 84 are provided in the same number, at the same pitch, and on the same circumference as the second spigot pins 80.

In this manner, at the same time as functioning as positioning means (spigot means) for positioning the other end of the cylinder tube 12 at a predetermined position with respect to the rod cover 16, the second spigot pins 80 also function as fixing means for fixing the second damper 82 to the rod cover 16.

In addition, when the piston unit 18 is displaced to the side of the rod cover 16 (in the direction of the arrow A), by the end thereof coming into abutment against the second damper 82, direct contact between the piston unit 18 and the rod cover 16 is avoided, and the occurrence of shocks and impact noises accompanying such contact is suitably prevented.

Further, a second rod hole 86 in which the later-described guide rod 124 is supported is formed at a position located further toward the central side of the rod cover 16 with respect to the second communication hole 52. As shown in FIG. 1, the second rod hole 86 opens toward the side of the inner wall surface 16*b* of the rod cover 16 (in the direction of the arrow B) and does not penetrate through to the outer wall surface 16*a*.

In addition, in a state in which the one end of the cylinder tube 12 is placed in abutment against the inner wall surface 14*b* of the head cover 14 and the other end thereof is placed in abutment against the inner wall surface 16*b* of the rod cover 16, the connecting rods 88 are inserted respectively through the four first and second holes 26, 50, fastening nuts 90 (see FIGS. 1, 3A, and 3B) are screw-engaged on both ends thereof, and the fastening nuts 90 are tightened until they come into abutment against the outer wall surfaces 14*a*, 16*a* of the head cover 14 and the rod cover 16. As a result, the cylinder tube 12 is fixed in a condition of being sandwiched and gripped between the head cover 14 and the rod cover 16.

Figure 5:
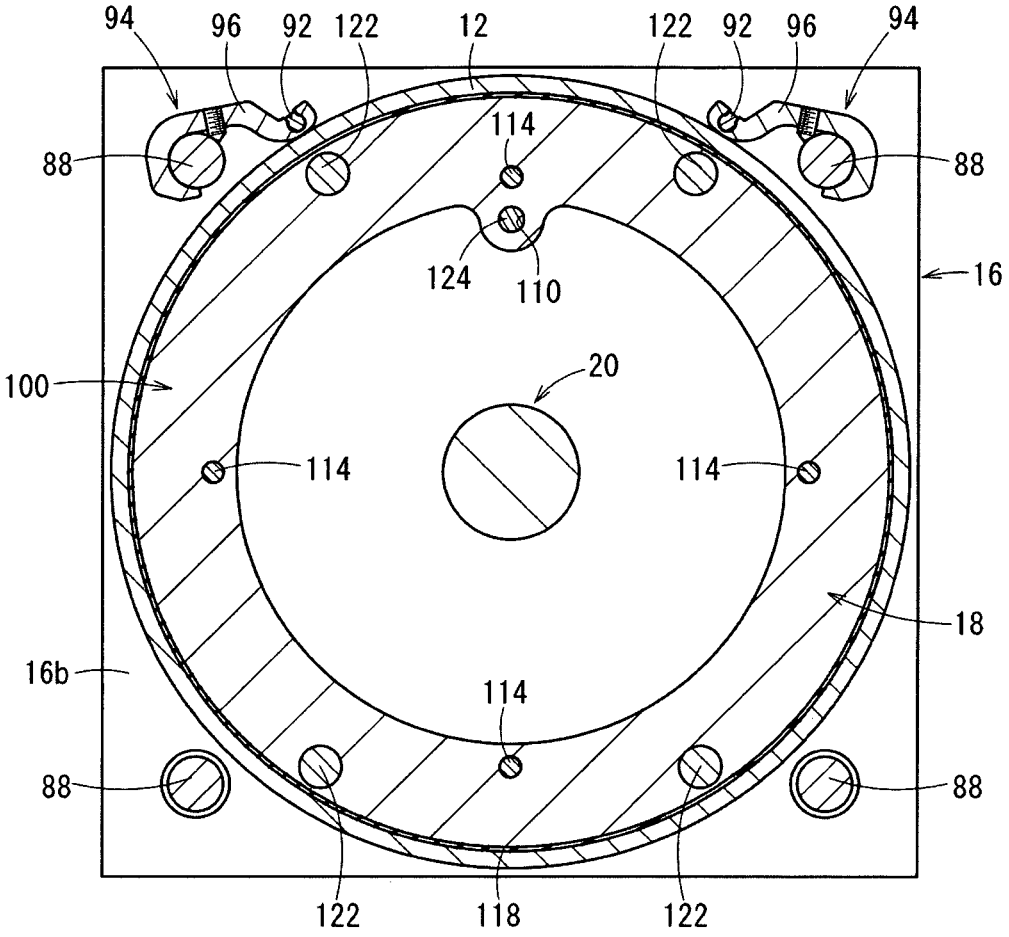
FIG. 5 is a cross-sectional view taken along line V-V of FIG. 1.
Figure 6:
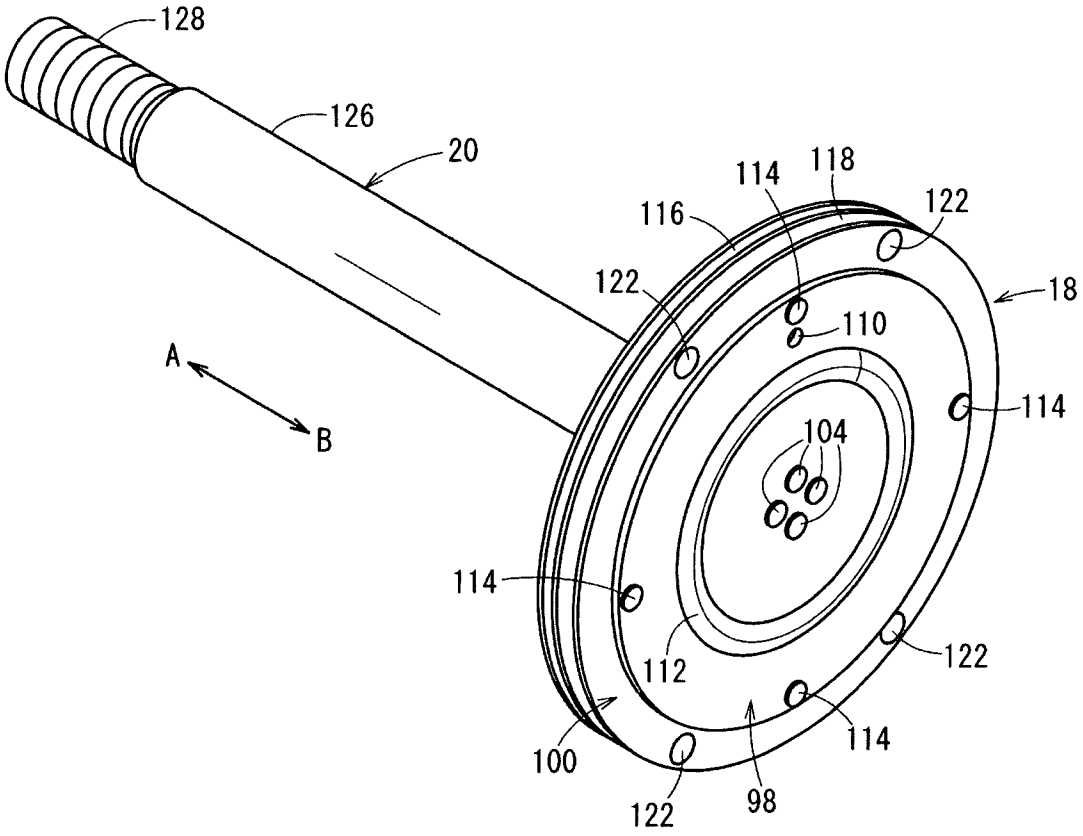
FIG. 6 is an external perspective view of a piston unit and a piston rod in the fluid pressure cylinder of FIG. 1.
Figure 7:
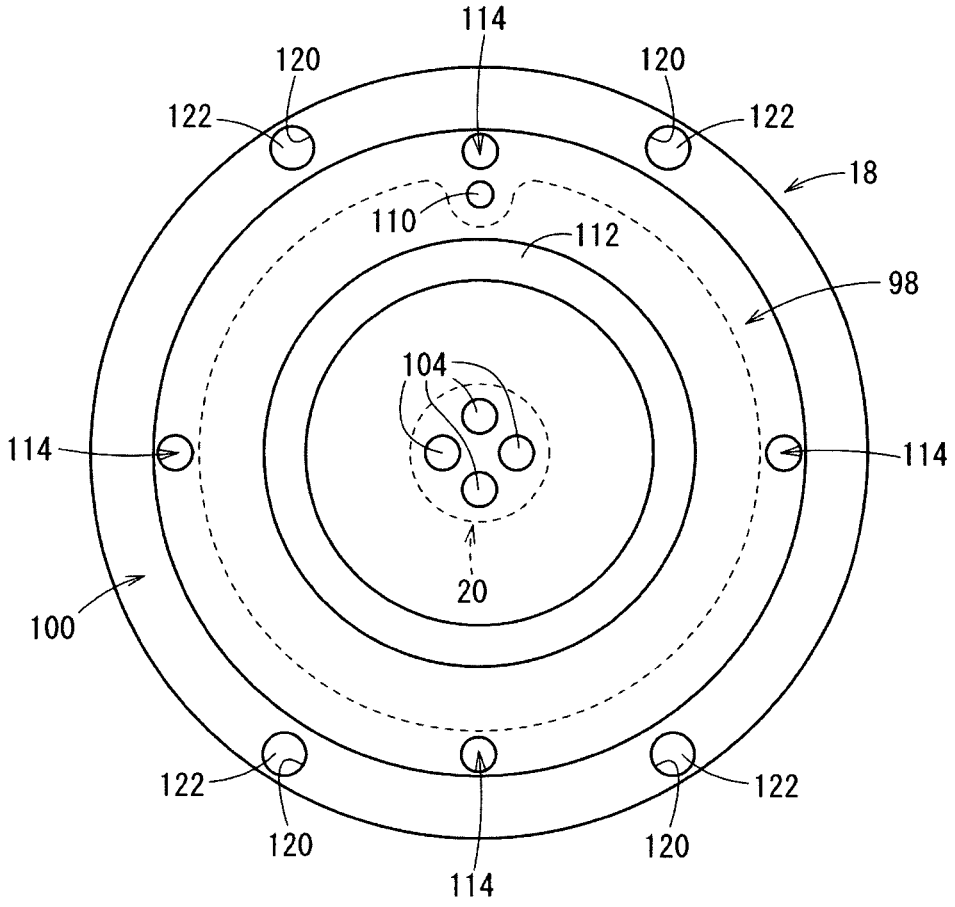
FIG. 7 is a front view of the piston unit shown in FIG. 6.

Further, as shown in FIG. 5, sensor retaining bodies 94 that hold detection sensors 92 for detecting the position of the piston unit 18 are disposed on the connecting rods 88. The sensor retaining bodies 94 are disposed substantially perpendicular with respect to the direction of extension of the connecting rods 88, and are disposed so as to be capable of moving along the connecting rods 88, together with including mounting sections 96 that extend from the locations retained on the connecting rods 88 and in which the detection sensors 92 are mounted. In the mounting sections 96, grooves, which are circular in cross section, for example, are formed substantially in parallel with the connecting rods 88, with the detection sensors 92 being housed and retained in the grooves.

The detection sensors 92 are magnetic sensors that are capable of detecting magnetism possessed by magnets 122 of a later-described ring body 100. The sensor retaining bodies 94 including the detection sensors 92 are selectively provided at a quantity as needed.

As shown in FIGS. 1, 2, 6, and 7, the piston unit 18 includes a disk shaped plate body 98, which is connected to one end of the piston rod 20, and the ring body 100 connected to an outer edge portion of the plate body 98.

The plate body 98, for example, is formed with a substantially constant thickness from a metal plate member having elasticity, and a plurality of (for example, four) second through holes 102 that penetrate therethrough in the thickness direction are disposed in a central portion of the plate body 98. In addition, second rivets (pin members) 104 are inserted into the second through holes 102, and by distal ends thereof being inserted into and engaged with second rivet holes 106 that are formed in the one end of the piston rod 20, the plate body 98 is connected substantially perpendicular to the one end of the piston rod 20.

The second rivets 104, for example, similar to the first rivets 60, are self-drilling rivets. After the second rivets 104 are inserted such that the flange members 66 thereof are placed on the side of the head cover 14 (in the direction of the arrow B) of the plate body 98, by punching the second rivets 104 into the interior of the piston rod 20, the second rivets 104 are engaged with respect to the second rivet holes 106, and the plate body 98 is fixed in engagement with respect to the piston rod 20.

Further, on an outer edge portion of the plate body 98, a plurality of (for example, four) third through holes 108 are provided that penetrate in the thickness direction. The third through holes 108 are formed at equal intervals mutually along the circumferential direction of the plate body 98, together with being formed on the same diameter with respect to the center of the plate body 98.

Furthermore, on the plate body 98, at a position more on an inner circumferential side than the third through holes 108, a rod insertion hole 110 is formed that penetrates in the thickness direction, and through which the later-described guide rod 124 is inserted.

Further still, on the plate body 98, at a position between the outer edge portion and the center portion that is fixed to the piston rod 20, for example, a rib 112 is included which has a curved shape in cross section. The rib 112 is formed in an annular shape along the circumferential direction, and is formed so as to project out toward an opposite side (in the direction of the arrow B) from the side of the piston rod 20. Further, the rib 112 may be formed to project out toward the side of the piston rod 20 (in the direction of the arrow A). Moreover, the rib 112 is formed at a position more on the inner circumferential side than the rod insertion hole 110.

By providing the rib 112, the degree of deflection of the elastic plate body 98 is set to a predetermined amount. Stated otherwise, by appropriately modifying the shape and position of the rib 112, the amount of deflection of the plate body 98 can be freely adjusted. Further, the aforementioned rib 112 need not necessarily be provided.

The plate body 98 is not limited to the case of being connected to the end of the piston rod 20 by the second rivets 104, and for example, the plate body 98 may be connected to the end of the piston rod 20 by press-fitting of a pin member into the end of the piston rod 20 and plastically deforming the end of the pin member.

The ring body 100, for example, is formed with a circular shape in cross section from a metal material, and the outer edge portion of the plate body 98 is placed in abutment against an edge portion thereof on the side of the head cover 14 (in the direction of the arrow B), and is fixed thereto by a plurality of third rivets 114. The third rivets 114, for example, similar to the first and second rivets 60, 104, are self-drilling rivets. After the third rivets 114 are inserted such that the flange members 66 thereof are placed on the side of the head cover 14 (in the direction of the arrow B) of the plate body 98, by punching the pin members 68 into third rivet holes 115 of the ring body 100, the pin members 68 are engaged and latched in the interior thereof.

Further, as shown in FIG. 2, a piston packing 116 and a wear ring 118 are disposed on the ring body 100 through annular grooves formed on the outer circumferential surface thereof, and by the piston packing 116 sliding in contact with the inner circumferential surface of the cylinder tube 12, leakage of pressure fluid through a gap between the ring body 100 and the cylinder tube 12 is prevented. Together therewith, by the wear ring 118 sliding in contact with the inner circumferential surface of the cylinder tube 12, the ring body 100 is guided in the axial direction (the directions of arrows A and B) along the cylinder tube 12.

Furthermore, as shown in FIGS. 1 and 2, on a side surface of the ring body 100 facing toward the head cover 14, a plurality of (for example, four) holes 120, which are opened in the axial direction, are formed, and cylindrical magnets 122 are press-fitted, respectively, into the interiors of the holes 120. The arrangement of the magnets 122 is such that, when the piston unit 18 is disposed in the interior of the cylinder tube 12, as shown in FIG. 5, the magnets 122 are disposed at positions facing toward the four connecting rods 88, and the magnetism of the magnets 122 is detected by the detection sensors 92 of the sensor retaining bodies 94 that are provided on the connecting rods 88.

As shown in FIGS. 1, 2, and 4A through 5, the guide rod 124 is formed as a shaft with a circular shape in cross section, with one end thereof being inserted into the first rod hole 46 of the head cover 14, and the other end thereof being inserted into the second rod hole 86 of the rod cover 16, together with being inserted through the rod insertion hole 110 of the plate body 98. Owing thereto, in the interior of the cylinder tube 12, the guide rod 124 is fixed to the head cover 14 and the rod cover 16, and is disposed in parallel with the axial direction (displacement direction) of the piston unit 18, together with the piston unit 18 being prevented from undergoing rotation when the piston unit 18 is displaced in the axial direction. Stated otherwise, the guide rod 124 functions as a rotation stop for the piston unit 18.

Further, an O-ring is disposed in the rod insertion hole 110, whereby leakage of pressure fluid through a gap between the guide rod 124 and the rod insertion hole 110 is prevented.

As shown in FIG. 1, the piston rod 20 is made up from a shaft having a predetermined length along the axial direction (the directions of arrows A and B), and includes a main body portion 126 formed with a substantially constant diameter, and a small diameter distal end portion 128 formed on the other end of the main body portion 126. The distal end portion 128 is disposed so as to be exposed to the outside of the rod cover 16 through the holder 54. The one end of the main body portion 126 is formed in a substantially planar surface shape perpendicular to the axial direction of the piston rod 20, and is connected to the plate body 98.

The fluid pressure cylinder 10 according to the first embodiment of the present invention is constructed basically as described above. Next, operations and advantageous effects of the fluid pressure cylinder 10 will be described. A condition in which the piston unit 18 is displaced to the side of the head cover 14 (in the direction of the arrow B) will be described as an initial position.

At first, a pressure fluid is introduced to the first port member 30 from a non-illustrated pressure fluid supply source. In this case, the second port member 74 is placed in a state of being open to atmosphere under a switching operation of a non-illustrated switching valve. Consequently, the pressure fluid is supplied from the first port member 30 to the port passage 32 and the first communication hole 28, and by the pressure fluid that is introduced into the cylinder chamber 22*a* from the first communication hole 28, the piston unit 18 is pressed toward the side of the rod cover 16 (in the direction of the arrow A). In addition, the piston rod 20 is displaced together with the piston unit 18, and by the end surface of the ring body 100 coming into abutment against the second damper 82, a displacement terminal end position is reached.

On the other hand, in the case that the piston unit 18 is to be displaced in the opposite direction (in the direction of the arrow B), together with the pressure fluid being supplied to the second port member 74, the first port member 30 is placed in a state of being open to atmosphere under a switching operation of the switching valve (not shown). In addition, the pressure fluid is supplied from the second port member 74, through the port passage 76 and the second communication hole 52, to the cylinder chamber 22*b*, and by the pressure fluid that is introduced into the cylinder chamber 22*b*, the piston unit 18 is pressed toward the side of the head cover 14 (in the direction of the arrow B).

The piston rod 20 is displaced while being guided under the displacement action of the piston unit 18, and the initial position is restored by the ring body 100 of the piston unit 18 coming into abutment against the first damper 42 of the head cover 14.

Further, when the piston unit 18 is displaced along the cylinder tube 12 in the axial direction (the directions of arrows A and B) in the manner described above, by being displaced along the guide rod 124 that is inserted through the interior of the piston unit 18, rotational displacement thereof does not take place, the magnets 122 provided in the piston unit 18 are positioned in facing relation to the detection sensors 92, and the displacement of the piston unit 18 can reliably be detected by the detection sensors 92.

In the foregoing manner, according to the first embodiment, in the piston unit 18 that constitutes the fluid pressure cylinder 10, the plate body 98 which is made up from a plate member is connected by the second rivets 104 to one end of the piston rod 20, and therefore, in comparison with the conventional fluid pressure cylinder in which the piston is connected by screws or the like with respect to the piston rod, it is possible to obtain roughly the same fastening force using the rivets (second rivets 104) which have a shorter axial length than such screws. As a result, compared to the conventional fluid pressure cylinder, the dimension of the piston unit 18 along the axial direction (the directions of arrows A and B) can be made shorter, and along therewith, the dimension of the fluid pressure cylinder 10 in the axial direction can be reduced in size.

Further, since the flange members 66 of the second rivets 104 are thinner than the head portions of general bolts or the like, on the piston unit 18, it is possible to reduce the amount by which the flange members 66 project out toward the side of the head cover 14 (in the direction of the arrow B), and it is possible to contribute to a reduction in the dimension (total length) of the piston unit 18.

On the other hand, the piston unit 18 is not limited to the structure described above. For example, as in a piston unit 150 shown in FIG. 8A, the piston unit 150 may be equipped with a bulging portion (positioning member) 158, which corresponds to one end of a piston rod 154 having a tapered part 152 thereon, and which is disposed in the center of a plate body 156 bulging out toward the side of the head cover 14 (in the direction of the arrow B), wherein the plate body 156 is connected to the piston rod 154 by a plurality of second rivets 104 through the bulging portion 158.

The bulging portion 158, for example, is formed substantially with a U-shape in cross section, and is made up from an inclined section 162 that is inclined with respect to a base section 160 of the plate body 156, and a flat section 164 formed on a distal end of the inclined section 162. The base section 160 and the flat section 164 are formed substantially in parallel. Further, the inclined section 162 is formed in an annular shape.

In addition, the bulging portion 158 is mounted so as to cover the one end of the piston rod 154, the flat section 164 is placed in abutment with the planar one end, and in a state with the inclined section 162 thereof abutting against the tapered part 152, the plate body 156 is fixed to the piston rod 154 by punching the plural second rivets 104 toward the side of the piston rod 154 in a perpendicular manner to the inclined section 162.

More specifically, the second rivets 104 are punched at a predetermined angle of inclination with respect to the axis of the piston rod 154.

In this manner, by disposing the bulging portion 158 in the center of the plate body 156, and connecting it by engagement with the one end of the piston rod 154, the plate body 156 can easily and reliably be positioned coaxially with the piston rod 154. Together therewith, by punching the second rivets 104 from an inclined angle with respect to the axis of the piston rod 154, since the direction of displacement of the piston unit 150 and the fastening direction of the second rivets 104 are not along a straight line, loosening of the fastened condition accompanying the displacement operation of the piston unit 150 is prevented.

Figure 8B:
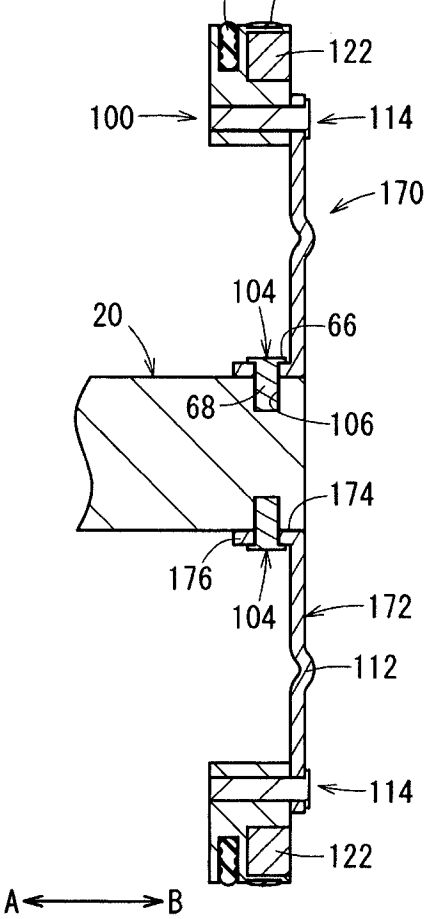
FIG. 8B is a cross-sectional view showing a piston unit according to a second modification.
Figure 8A:
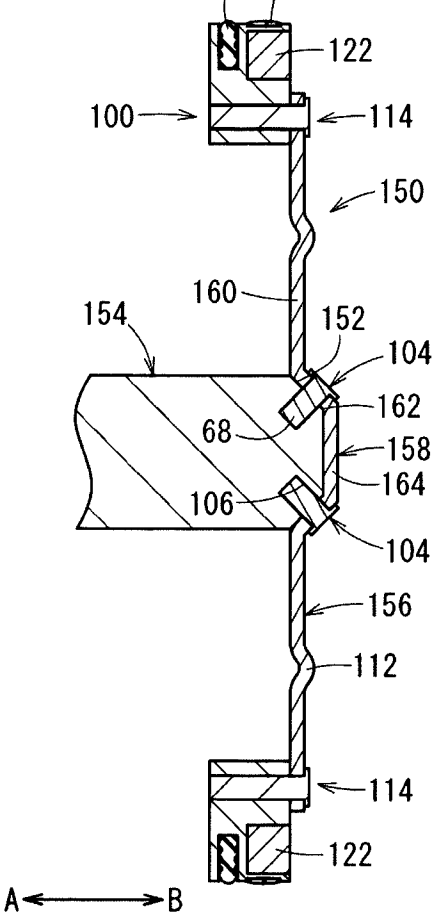
FIG. 8A is a cross-sectional view showing a piston unit according to a first modification.

Further, as in a piston unit 170 shown in FIG. 8B, an insertion hole 174 in which the piston rod 20 can be inserted may be provided in a central portion of a plate body 172, and a tubular member 176 may be provided to extend in an axial direction (the direction of the arrow A) from the insertion hole 174. Further, in a state in which one end of the piston rod 20 is inserted into the tubular member 176 and the insertion hole 174, plural second rivets 104 are punched toward the piston rod 20 from an outer circumferential side of the tubular member 176, whereby the members may be connected together mutually.

In this case as well, in the same manner as the aforementioned piston unit 150, by insertion of the piston rod 20 into the insertion hole 174 of the plate body 172, the plate body 172 can be positioned easily and reliably in a coaxial manner with respect to the piston rod 20. Further, by punching the second rivets 104 into the plate body 172 from a direction substantially perpendicular to the axis of the piston rod 20, since the displacement direction (the directions of arrows A and B) of the piston unit 170 and the fastening direction of the second rivets 104 are perpendicular to one another and not in the same direction, loosening of the fastened condition accompanying the displacement operation of the piston unit 170 can reliably be prevented.

Figure 9:
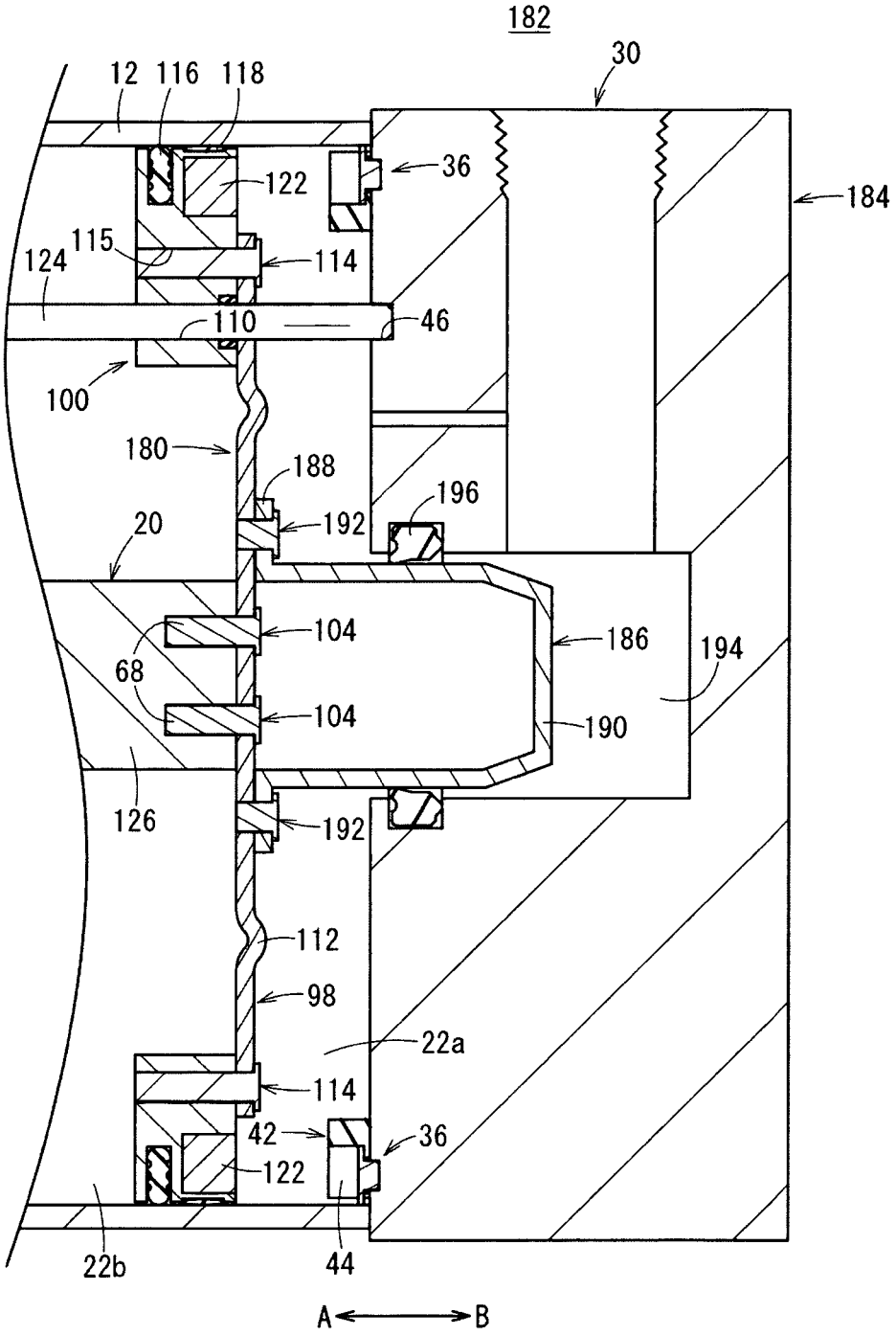
FIG. 9 is a cross-sectional view showing a piston unit according to a third modification.

A piston unit 180 shown in FIG. 9 is disposed in a fluid pressure cylinder 182 including a cushion mechanism, in which a cylindrical cushion member 186 is connected to a side surface of the plate body 98 that faces toward a head cover 184.

The cushion member 186 is formed, for example, in a bottomed cylindrical shape, with a mounting flange 188, which is expanded radially outward, being formed at the opening thereof. In addition, in the cushion member 186, a bottomed part 190 thereof is located on the side of the head cover 184 (in the direction of the B), and in a state in which the mounting flange 188 is placed in abutment against the plate body 98, the mounting flange 188 and the plate body 98 are connected together by a plurality of fourth rivets 192.

The mounting flange 188 of the cushion member 186 is fixed at a position on an outer side of the second rivets 104.

Additionally, by the piston unit 180 being displaced under the supply of a pressure fluid toward the side of the head cover 184 (in the direction of the arrow B), the cushion member 186 being inserted gradually into a cushion hole 194 of the head cover 184, and undergoing displacement while sliding along a sealing ring 196 provided on an outer circumferential surface thereof, the flow rate of the pressure fluid is throttled and becomes compressed in the interior of the cylinder chamber 22*a*. As a result, a resistance to displacement occurs when the piston unit 180 is displaced, and the displacement speed of the piston unit 180 gradually decelerates as the piston unit 180 approaches its displacement terminal end position.

In this manner, since the cushion member 186 can easily be added by the cushion member 186 being connected by the fourth rivets 192 to the plate body 98 of the piston unit 180, it can be adapted to the fluid pressure cylinder 182 having a cushion mechanism. Further, the cushion member 186 can appropriately be selected and mounted responsive to the desired characteristics of the cushion mechanism.

Figure 10:
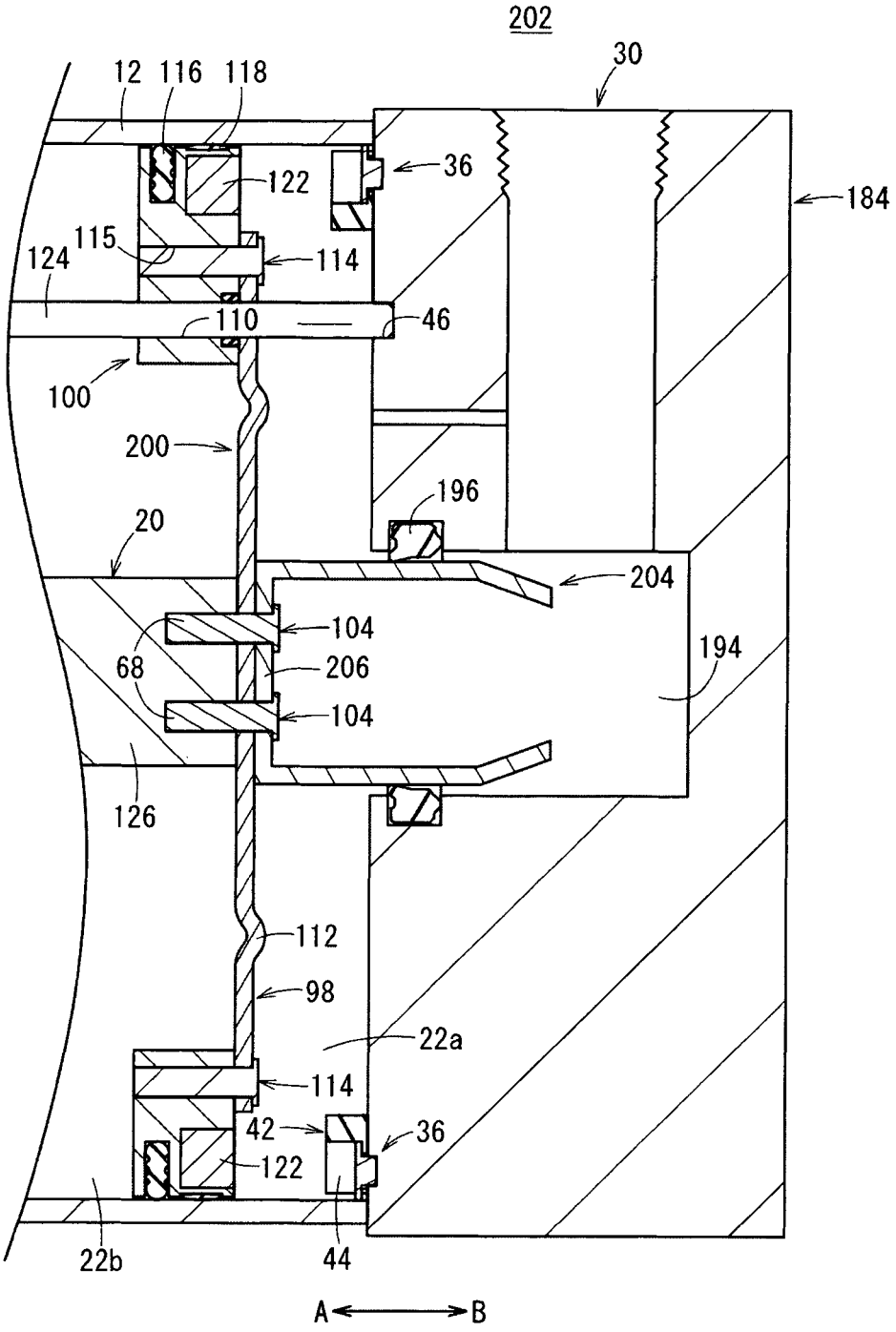
FIG. 10 is a cross-sectional view showing a piston unit according to a fourth modification.

Further, the cushion member 186 is not limited to a structure in which it is formed with a bottomed cylindrical shape, as in the above described piston unit 180, wherein the bottomed part 190 thereof is arranged on an end on a side opposite from the piston rod 20. For example, as in a fluid pressure cylinder 202 having a piston unit 200 shown in FIG. 10, a bottomed cylindrical shaped cushion member 204 may be used in which an end on a side opposite from the piston rod 20 is open.

The cushion member 204 is formed with a U-shape in cross section, a bottom 206 thereof abuts against a side surface of the plate body 98 coaxially with the piston rod 20, and is connected by second rivets 104 to one end of the piston rod 20 together with the plate body 98. Stated otherwise, the cushion member 204 is fastened to the piston rod 20 together with the plate body 98.

In a state in which the second rivets 104 are inserted into the interior of the cushion member 204 from the open end, and the flange members 66 thereof are arranged on the side of the head cover 184, the cushion member 204, the plate body 98, and the piston rod 20 are connected together integrally by punching the head portions thereof from the open end side by a non-illustrated driving apparatus.

In this manner, since the cushion member 204 can easily be added by the second rivets 104 to the plate body 98 of the piston unit 200, it can be adapted to the fluid pressure cylinder 202 having the cushion mechanism.

Further, because the cushion member 204 can be fixed using the second rivets 104 that serve to connect the plate body 98 and the piston rod 20, without increasing the quantity of rivets, an increase in the number of parts can be suppressed, together with enabling a reduction in the number of assembly steps.

Figure 11:
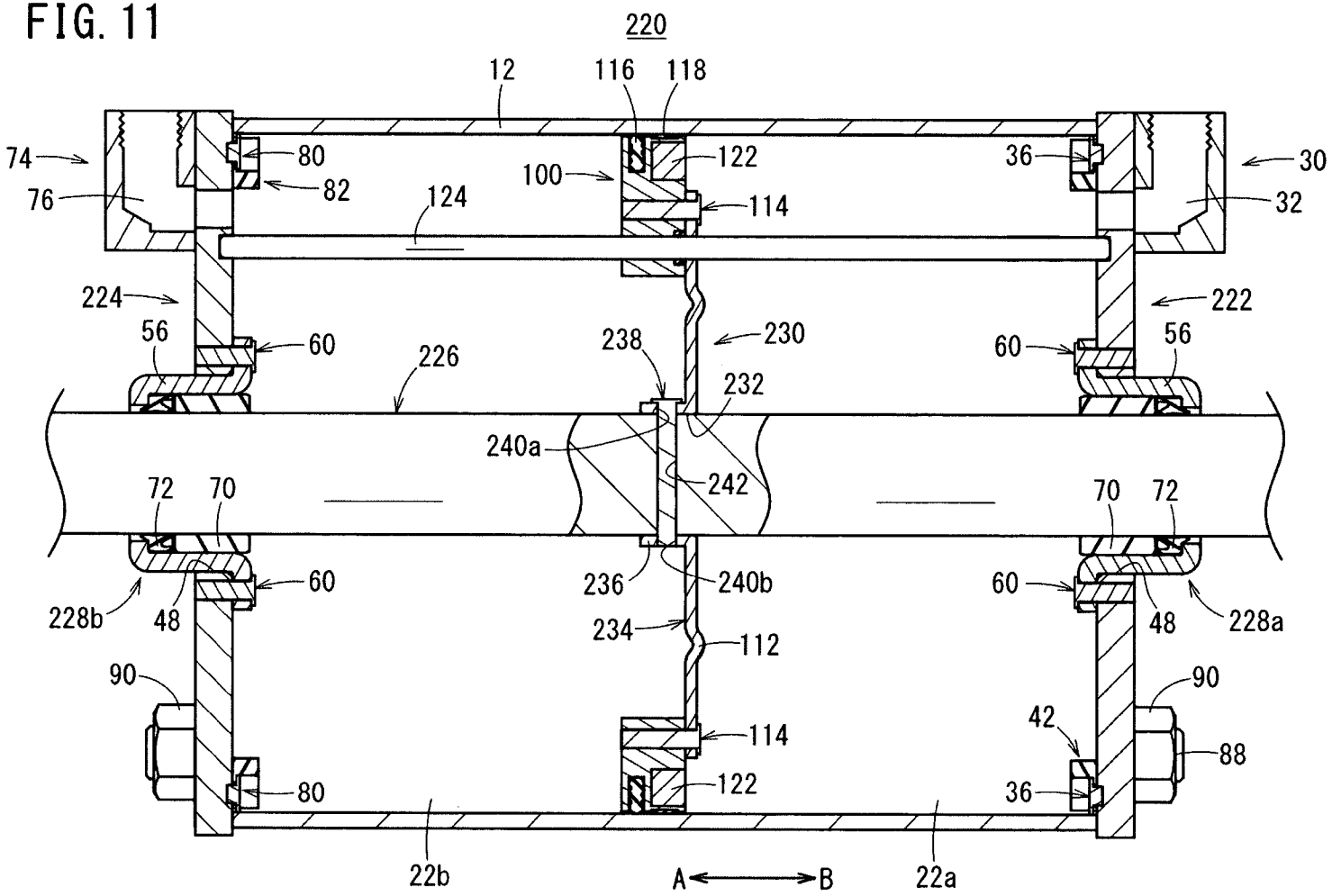
FIG. 11 is an overall cross-sectional view of a fluid pressure cylinder according to a second embodiment of the present invention.

Next, a fluid pressure cylinder 220 according to a second embodiment is shown in FIG. 11. Constituent elements thereof, which are the same as those of the fluid pressure cylinder 10 according to the above-described first embodiment, are denoted using the same reference characters, and detailed description of such features is omitted.

The fluid pressure cylinder 220 differs from the single rod type of fluid pressure cylinder 10 according to the first embodiment, in that it is a dual rod type of fluid pressure cylinder, in which both ends of a piston rod 226 project out respectively from first and second end covers 222, 224 disposed on both ends of the cylinder tube 12.

As shown in FIG. 11, the fluid pressure cylinder 220 is equipped with the respective first and second end covers 222, 224 on both ends of the cylinder tube 12, and the first and second end covers 222, 224 are formed in substantially symmetrical shapes sandwiching the cylinder tube 12 therebetween. In roughly central portions of the first and second end covers 222, 224, holders 228*a*, 228*b* are disposed through respective rod holes 48, and are fixed respectively therein by the first rivets 60.

Further, a piston unit 230, which is disposed in the interior of the cylinder tube 12, includes a plate body 234 having an insertion hole 232 substantially in the center thereof, and a ring body 100 connected to an outer edge portion of the plate body 234. A substantially central portion of the piston rod 226 is inserted through the insertion hole 232. In addition, the piston rod 226 and a tubular section 236 of the plate body 234, which extends from the insertion hole 232, are fixed together in a radial direction by a second rivet 238.

The second rivet 238 is inserted toward the side of the piston rod 226 through a second through hole 240*a* formed in the tubular section 236 of the plate body 234, and by being punched into a second rivet hole 242, which penetrates through the piston rod 226 in a direction substantially perpendicular to the axis, a projecting distal end of the second rivet 238 is made to engage with a second through hole 240*b* of the tubular section 236 on the opposite side. More specifically, the second rivet 238 is punched in a direction substantially perpendicular to the axis of the piston rod 226.

The connection between the plate body 234 and the piston rod 226 is not limited to the case of being carried out by a single second rivet 238 as described above. For example, the plate body 234 and the piston rod 226 may be connected together mutually by punching a plurality of second rivets 238 toward the side of the piston rod 226 from the outer circumferential side of the tubular section 236.

Additionally, one end of the piston rod 226 is supported displaceably and projects out to the exterior through the holder 228*a* that is fixed to the first end cover 222, whereas the other end of the piston rod 226 is supported displaceably and projects out to the exterior through the holder 228*b* that is fixed to the second end cover 224.

With the fluid pressure cylinder 220, for example, by supplying a pressure fluid to the cylinder chamber 22*a* from a first port member 30 that is disposed on the first end cover 222, the piston unit 230 is pressed and displaced toward the side of the second end cover 224 (in the direction of the arrow A), and together with the one end side of the piston rod 226 gradually being accommodated in the interior of the cylinder tube 12, the other end side of the piston rod 226 gradually is made to project outside from the second end cover 224.

On the other hand, in the case that the piston unit 230 is to be displaced in the opposite direction (the direction of the arrow B), by supplying a pressure fluid to the cylinder chamber 22*b* through the second port member 74, the piston unit 230 is pressed and displaced toward the side of the first end cover 222 (in the direction of the arrow B), and together with the one end side of the piston rod 226 gradually being made to project outside from the first end cover 222, the other end of the piston rod 226 is gradually accommodated in the interior of the cylinder tube 12.

In the foregoing manner, according to the second embodiment, the piston unit 230 is disposed at a substantially central portion of the single piston rod 226, and by punching the second rivet 238 toward the side of the piston rod 226 from the outer circumferential side of the plate body 234, the piston unit 230 of the dual rod type fluid pressure cylinder 220 can easily be constructed.

Further, because the piston unit 230 is fixed without performing any machining with respect to the piston rod 226, by dual use of the single piston rod 226 to change the position of the piston unit 230, the configuration can easily be adapted to changes in specifications.

The fluid pressure cylinder according to the present invention is not limited to the above embodiments. It is a matter of course that various changes and modifications may be made to the embodiments without departing from the scope of the invention as set forth in the appended claims.

The invention claimed is:

1. A fluid pressure cylinder comprising:

a cylinder tube;

a cover member attached to an end of the cylinder tube, which end is an axial end of the cylinder tube relative to the direction of the axis of the cylinder tube;

a piston rod extending along the axial direction in the cylinder tube, the piston rod having an axial end relative to the direction of the axis of the cylinder tube, wherein the piston rod is displaceable in the cylinder tube along the direction of the axis of the cylinder tube;

a piston dividing the interior of the cylinder tube into two cylinder chambers, wherein the piston comprises a central portion provided as an elastic plate body having a surface facing one of said two cylinder chambers, which one of said two cylinder chambers is closer to said cover member than is another of said two cylinder chambers, said surface being mounted to the axial end of the piston rod, wherein the piston further comprises an annular ring-body disposed at an outer edge portion of the plate body and configured to slide along an inner circumferential surface of the cylinder tube;

a bore in a surface of said annular ring-body that faces said one of said two cylinder chambers;

a magnet housed in said bore and having a surface exposed to said one of said two cylinder chambers;

a pin member fixing the central portion of the plate body to the axial end of the piston rod with said surface being mounted to the axial end of the piston rod, wherein no portion of said annular ring-body extends axially beyond the central portion in a direction toward the other of said two cylinder chambers, and wherein said central portion extends axially beyond any portion of the annular ring-body in the direction toward the other of said two cylinder chambers.

2. The fluid pressure cylinder according to claim 1, wherein the pin member comprises a rivet that is punched with respect to the piston rod along an axial direction of the piston rod.

3. The fluid pressure cylinder according to claim 1, wherein the pin member is punched with respect to the piston rod at a predetermined angle of inclination with respect to an axial direction of the piston rod.

4. The fluid pressure cylinder according to claim 3, wherein a positioning member is included in a central portion of the plate body, an end of the piston rod is inserted into the positioning member and positioned coaxially therewith, and the plate body and the piston rod are connected by the pin member through the positioning member.

5. The fluid pressure cylinder according to claim 1, further comprising, in a central portion of the plate body, a cushion member, which projects out in a direction away from the piston rod, the cushion member being fixed by the pin member with respect to the plate body, and by the cushion member being accommodated in an accommodating hole of the cover member, a displacement speed of the piston is decelerated.

6. The fluid pressure cylinder according to claim 1, wherein the surface of said magnet that is exposed to said one of said two cylinder chambers is coplanar with the surface of said annular ring-body that faces said one of said two cylinder chambers.

7. The fluid pressure cylinder according to claim 1, further comprising a damper provided on the cover member at a radial location corresponding to the magnet.

* * * * *